US008746873B2

(12) United States Patent
Tsukamoto et al.

(10) Patent No.: US 8,746,873 B2
(45) Date of Patent: Jun. 10, 2014

(54) IMAGE FORMING APPARATUS AND IMAGE FORMING METHOD

(75) Inventors: Takeo Tsukamoto, Kanagawa (JP); Yuuma Usui, Kanagawa (JP); Manabu Seo, Kanagawa (JP); Aino Hasegawa, Kanagawa (JP); Takeshi Orito, Kanagawa (JP); Ryota Suzuki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 212 days.

(21) Appl. No.: 13/138,117

(22) PCT Filed: Nov. 5, 2009

(86) PCT No.: PCT/JP2009/069237
§ 371 (c)(1),
(2), (4) Date: Jul. 8, 2011

(87) PCT Pub. No.: WO2010/095319
PCT Pub. Date: Aug. 26, 2010

(65) Prior Publication Data

US 2011/0273523 A1 Nov. 10, 2011

(30) Foreign Application Priority Data

Feb. 19, 2009 (JP) ..... 2009-037033

(51) Int. Cl.
*B41J 2/01* (2006.01)

(52) U.S. Cl.
USPC ..... 347/103; 347/88; 347/89; 347/100; 347/101; 347/111; 347/112; 347/159

(58) Field of Classification Search
CPC ..... B41J 2/01
See application file for complete search history.

(56) References Cited

U.S. PATENT DOCUMENTS 6,257,716 B1 * 7/2001 Yanagawa et al. ..... 347/102
7,281,790 B2 * 10/2007 Mouri et al. ..... 347/103

(Continued)

FOREIGN PATENT DOCUMENTS

JP 59-041279 A 3/1984
JP 63-218363 A 9/1988

(Continued)

OTHER PUBLICATIONS

Supplementary European Search Report dated Apr. 24, 2012 issued in corresponding European Application No. 09840422.1.

(Continued)

*Primary Examiner* — Manish S Shah
*Assistant Examiner* — Jeremy Delozier
(74) *Attorney, Agent, or Firm* — Harness, Dickey & Pierce, P.L.C.

(57) ABSTRACT

A disclosed image forming apparatus includes a recording head having a nozzle capable of ejecting inductive ink including water, a first intermediate transfer body having a conductive surface on which an ink image is to be formed by temporarily forming a liquid-column bridge between the conductive surface and the nozzle, the liquid-column bridge being made of the inductive ink, a voltage application unit applying a voltage between the inductive ink and the conductive surface so that water included in the liquid-column bridge is electrolyzed, and a transfer unit transferring an ink image formed on the first intermediate transfer body to a recording medium.

12 Claims, 17 Drawing Sheets

(56) References Cited

U.S. PATENT DOCUMENTS

| | | | | |
|---|---|---|---|---|
| 7,661,809 | B2 * | 2/2010 | Taniuchi et al. | 347/103 |
| 8,025,388 | B2 * | 9/2011 | Kadomatsu et al. | 347/103 |
| 8,182,079 | B2 * | 5/2012 | Makuta | 347/102 |
| 8,226,225 | B2 * | 7/2012 | Yamanobe | 347/103 |
| 8,337,953 | B2 * | 12/2012 | Nakazawa et al. | 427/261 |
| 2001/0022607 | A1 * | 9/2001 | Takahashi et al. | 347/103 |
| 2003/0067528 | A1 * | 4/2003 | Chowdry et al. | 347/103 |
| 2006/0170752 | A1 | 8/2006 | Kadomatsu et al. | |
| 2008/0055356 | A1 | 3/2008 | Yamanobe | |
| 2008/0055385 | A1 | 3/2008 | Houjou | |

FOREIGN PATENT DOCUMENTS

| | | | | |
|---|---|---|---|---|
| JP | 11-188858 | A | 7/1999 | |
| JP | 11-207946 | * | 8/1999 | B41J 2/01 |
| JP | 11-207946 | A | 8/1999 | |
| JP | 2002138228 | A | 5/2002 | |
| JP | 2002-283716 | | 10/2002 | |
| JP | 2003-136689 | A | 5/2003 | |
| JP | 4036071 | B2 | 4/2004 | |
| JP | 2006-130769 | A | 5/2006 | |
| JP | 2006-205677 | A | 8/2006 | |
| JP | 2007-301993 | A | 11/2007 | |
| JP | 2008-062397 | A | 3/2008 | |

OTHER PUBLICATIONS

International Search Report mailed Jan. 26, 2010.

English language abstract for JP-2004-122721 which corresponds to JP-4036071-B2.

* cited by examiner

IMAGE FORMING APPARATUS AND IMAGE FORMING METHOD

TECHNICAL FIELD

The present invention relates to an image forming apparatus and an image forming method.

BACKGROUND ART

As inkjet recording methods, they are known methods including an actuator driven method represented by a piezoelectric inkjet recording method and a heating and film boiling method represented by a thermal inkjet recording method. In any method, in accordance with image data to be printed, ink is ejected from a nozzle of a recording head so that the image data are formed. When compared with the electrophotographic recording method, the inkjet recording method can be implemented easier; therefore, the inkjet recording method is applied in various image forming apparatuses such as a printer, a facsimile machine, a copier and the like.

As a main part of an imaging engine, such an image forming apparatus includes a recording head having a nozzle from which ink is ejected. If a process that the ink ejected from the nozzle of the recording head is printed on a recording paper is performed near the recording head, paper powder from the recording paper or dust is more likely to be adhered to the nozzle. As a result, a flying direction of the ink may deviate from a desired flying direction and/or the nozzle may be clogged due to the paper powder or dust; thereby degrading a quality of printed image and reducing the reliability of printing. Further, from the viewpoints of emission stability, a low-viscosity ink is generally used. However, when such a low-viscosity ink is used, bleeding of ink (ink bleeding) is more likely to occur when the ink is deposited on the surface of the recording paper.

To avoid the problem, there is a known method employed in which an intermediate transfer body is provided on which ink image is formed with the ink ejected from the nozzle of the recording head so that the formed ink image on the intermediate transfer body is separately transferred to a recording medium.

Patent Document 1 discloses an image forming apparatus including a treatment liquid application unit applying a treatment liquid for changing a pH of ink onto an intermediate transfer body, an ink application unit applying ink onto the treatment liquid on the intermediate transfer body, and a transfer unit transferring an image formed on the intermediate transfer body to a recording medium. In this case, in the ink, at least a pigment and polymer fine particles are dispersed in a medium including water and a water-soluble solution; and the pigment and the polymer fine particles are aggregated by changing the pH of the ink. However, in this method, it is always required to apply a treatment liquid to aggregate the pigment in the ink, which becomes necessary to add a device for applying the treatment liquid and may reduce a printing speed.

Patent Document 1: Japanese Patent Application Publication No. 2008-62397

DISCLOSURE OF THE INVENTION

Problems to be Solved by the Invention

The present invention is made in light of the above problems and may provide an image forming apparatus and an image forming apparatus capable of controlling the occurrence of ink bleeding without applying (using) a treatment liquid.

Means for Solving the Problems

According to a first aspect of the present invention, an image forming apparatus includes a recording head having a nozzle capable of ejecting inductive ink including water, a first intermediate transfer body having a conductive surface on which an ink image is to be formed by temporarily forming a liquid-column bridge between the conductive surface and the nozzle, the liquid-column bridge being made of the inductive ink, a voltage application unit applying a voltage between the inductive ink and the conductive surface so that water included in the liquid-column bridge is electrolyzed, and a transfer unit transferring the ink image formed on the first intermediate transfer body to a recording medium.

According to a second aspect of the present invention, in the image forming apparatus according to the first aspect of the present invention, the conductive surface includes rubber in which a conductive agent is dispersed or metal.

According to a third aspect of the present invention, the image forming apparatus according to the first or the second aspect of the present invention further includes a second intermediate transfer body having a surface on which a rubber layer is formed, wherein the transfer unit primarily transfers the ink image formed on the first intermediate transfer body to the second intermediate transfer body and then secondarily transfers the ink image primarily transferred on the second intermediate transfer body to a recording medium.

According to a fourth aspect of the present invention, an image forming method includes an image forming step of forming an ink image on an intermediate transfer body by discharging inductive ink including water from a nozzle of a recording head and a transfer step of transferring the ink image formed on the intermediate transfer body to a recording medium, wherein the intermediate transfer body includes a conductive surface and, while a voltage is applied between the inductive ink and the conductive surface, by temporarily forming a liquid-column bridge made of the inductive ink between the nozzle and the conductive surface and electrolyzing the water included in the liquid-column bridge, the ink image is formed on the intermediate transfer body.

According to a fifth aspect of the present invention, in the image forming method according to the fourth aspect of the present invention, in the conductive ink, a pigment is dispersed with an anionic dispersant.

According to a sixth aspect of the present invention, in the image forming method according to the fifth aspect of the present invention, near the conductive surface, the water included in the liquid-column bridge is oxidized so as to produce protons to aggregate the pigment.

According to a seventh aspect of the present invention, in the image forming method according to the sixth aspect of the present invention, the conductive surface is made of metal and, near the conductive surface, the metal is oxidized to produce metal ions so as to aggregate the pigment.

According to an eighth aspect of the present invention, in the image forming method according to any one of fourth through seventh aspects of the present invention, the transfer step includes a step of primarily transferring the ink image formed on the intermediate transfer body to another intermediate transfer body having a surface on which a rubber layer is formed and a step of secondarily transferring the ink image primarily transferred on the another intermediate transfer body to a recording medium.

Effects of the Present Invention

According to an embodiment of the present invention, there may be provided an image forming apparatus and an image forming apparatus capable of controlling the occurrence of ink bleeding without applying (using) a treatment liquid.

DESCRIPTION OF THE REFERENCE NUMERALS

10,10': INTERMEDIATE TRANSFER BODY
11: CONDUCTIVE SUBSTRATE
12: CONDUCTIVE LAYER
12': RUBBER LAYER
20: RECORDING HEAD
21: NOZZLE PLATE
21*a*: NOZZLE
22: INK CHAMBER
30: POWER SOURCE
40: TRANSFER ROLLER
50, 50': CLEANING BLADE
100: IMAGE FORMING APPARATUS
I: CONDUCTIVE INK
I': INK IMAGE

BEST MODE FOR CARRYING OUT THE INVENTION

Next, the embodiments of the present invention are described with reference to the accompanying drawings.

Figure 1:
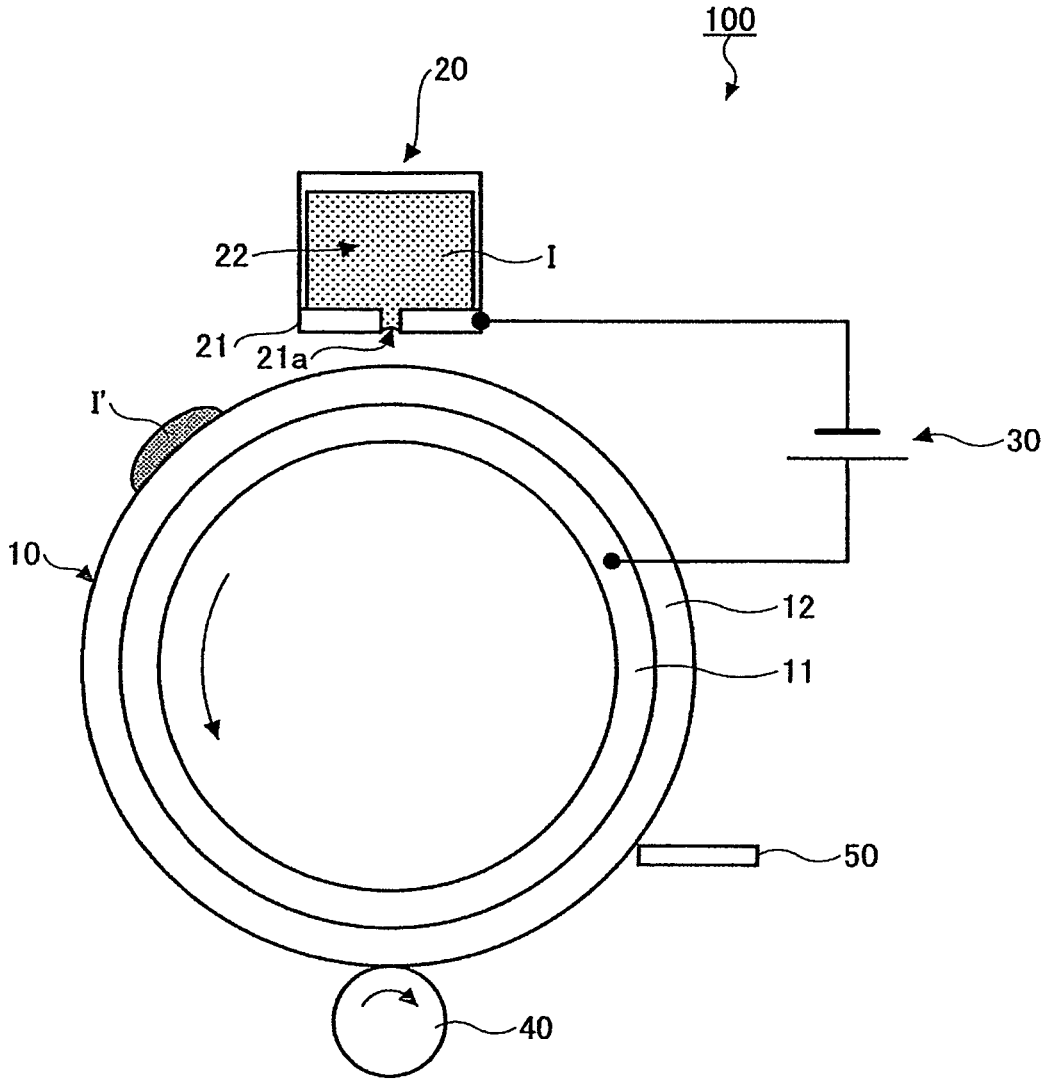
FIG. 1 is a schematic drawing showing an example of an image forming apparatus according to an embodiment of the present invention.

FIG. 1 shows an exemplary schematic configuration of an image forming apparatus 100 according to an embodiment of the present invention. As shown in FIG. 1, the image forming apparatus 100 includes an intermediate transfer drum 10, a recording head 20 ejecting conductive ink I onto an outer circumference of the intermediate transfer drum 10 so as to form an ink image I' on the intermediate transfer drum 10, a power source 30, a transfer roller 40 transferring the ink image I' formed on the intermediate transfer drum 10 to a recording paper (not shown), and a cleaning blade 50 cleaning the intermediate transfer drum 10 after the ink image I' is transferred.

The intermediate transfer drum 10 includes a conductive substrate 11 and a conductive layer 12 formed on the outer surface of the conductive substrate 11. The intermediate transfer drum 10 is driven to be rotated by a drive means (not shown). There are no particular restrictions on the material of the conductive substrate 11 and specific examples of the material of the conductive substrate 11 include aluminum, aluminum alloy, copper, stainless and the like. Further, the conductive layer 12 includes rubber in which a conductive agent is dispersed. The volume resistivity of the conductive layer 12 is smaller than that of the conductive ink I and is preferably less than $1\times10^3$ Ω·cm. There are no particular restrictions on the conductive agent but due to corrosion resistance property, carbon, platinum, gold or the like is preferably used. Further, there are no particular restrictions on the rubber and, for example, silicone rubber, urethane rubber, fluoro rubber, nitrile-butadiene rubber or the like is preferably used. Further, as the above intermediate transfer drum 10, the conductive substrate 11 without conductive layer 12 may be used. Further, an endless belt may be used as the intermediate transfer drum 10.

The recording head 20 is a fixed full-line type and includes a nozzle plate 21 through which plural nozzles 21*a* are formed, ink chambers 22, and ink ejecting means (not shown) corresponding to the nozzles 21*a*. In this case, the nozzle plate 21 is a conductive plate and the conductive ink I is filled in the ink chambers 22 by an ink supply means (not shown). As the ink ejecting means, a piezoelectric element is typically used and in accordance with a voltage pulse applied to the piezoelectric element, the conductive ink I is ejected (discharged) from the nozzle 21*a*. Instead of using the conductive nozzle plate 21, a nozzle plate having an inner surface contacting the conductive ink I, a conductive treatment being applied to the inner surface only, may be alternatively used. Further, instead of the conductive nozzle plate 21, an insulating nozzle plate having a conductive member capable of being electrically connected with the conductive ink I may be alternatively used. Further, there are no particular restrictions on the ink ejecting means and, for example, a method of using a shape deformation element other than the piezoelectric element may be used or a method such as using a heater may be used. Further, as the recording head, a shuttle-type recording head may be used, moving in the direction perpendicular to the moving direction of the surface of the intermediate transfer drum 10 (i.e., in the main scanning direction).

In the conductive ink I, a pigment is dispersed in water with an anionic dispersant.

There are no particular restrictions on the pigment used in an embodiment of the present invention, and specific examples of orange and yellow pigments are: C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 74, C.I. Pigment Yellow 93, C.I. Pigment Yellow 94, C.I. Pigment Yellow 128, C.I. Pigment Yellow 138, C.I. Pigment Yellow 151, C.I. Pigment Yellow 155, C.I. Pigment Yellow 180, and C.I. Pigment Yellow 185. Specific examples of red and magenta pigments are: C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48, C.I. Pigment Red 53, C.I. Pigment Red 57, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222. Specific examples of green and cyan pigments are: C.I. Pigment Blue 15, C.I. Pigment Blue 15:2, C.I. Pigment Blue 15:3, C.I. Pigment Blue 16, C.I. Pigment Blue 60, and C.I. Pigment Green 7. Specific examples of a black pigment are: C.I. Pigment Black 1, C.I. Pigment Black 6, and C.I. Pigment Black 7.

The content of the pigment in the conductive ink I is typically in a range of 0.1 to 40 wt %, preferably in a range of 1 to 30 wt %, and more preferably in a range of 2 to 20 wt %.

There are no particular restrictions on the anionic dispersant used in an embodiment of the present invention, and specific examples of anionic dispersant are fatty acid salt, alkyl sulfuric acid ester salt, alkyl benzene sulfonic acid salt, alkyl naphthalene sulfonic acid salt, dialkyl sulfosuccinic acid salt, alkyl phosphate ester salt, naphthalene sulfonic acid-formalin condensate, polyoxyethylene alkyl sulfuric acid ester salt and any combination thereof.

Preferably, from the viewpoints of transfer properties, the conductive ink I may further include resin containing anionic group prepared by neutralizing carboxyl group, sulfonic acid group, phosphonic acid group or the like with a base.

The conductive ink I may further include water-soluble solvent. There is no particular restrictions on the water-soluble solvent, and specific examples of the water-soluble solvent are polyalcohols such as ethylene glycol, diethylene glycol, propylene glycol, butylene glycol, triethylene glycol, 1,5-pentane diol, and 1,2,6-hexanetriol; poly alcohol derivatives such as ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, propylene glycol monobutyl ether, dipropylene glycol monobutyl ether, and ethylene oxide adduct of diglycerin; nitrogen-containing solvents such as pyrrolidone, N-methyl-2-pyrrolidone, cyclohexyl pyrrolidone, and triethanolamine; alcohols such as ethanol, isopropyl alcohol, butyl alcohol, and benzyl alcohol; sulfur-containing solvent such as thiodiethanol, thiodiglycerol, sulfolane, and dimethylsulfoxide; carbonic alkylene such as carbonic propylene and carbonic ethylene and any combination thereof.

From the viewpoints of preservation stability, preferably, the conductive ink I has an alkaline property.

Figure 2:
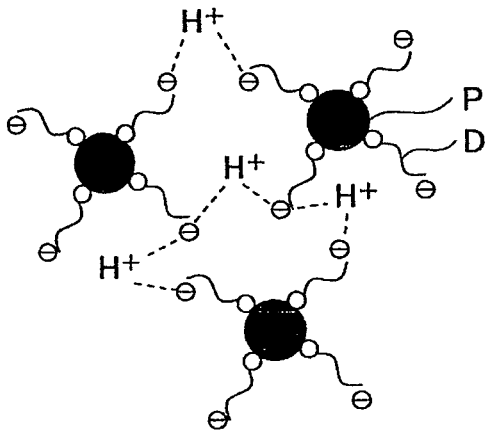
FIG. 2 is a drawing showing where pigments that were dispersed in anionic dispersant are aggregated together with protons.

The power source 30 is connected between the nozzle plate 21 and the conductive substrate 11 so as to apply a predetermined voltage between the conductive ink I and the conductive layer 12. The voltage output from the power source 30 can be changed using a voltage change means (not shown). Due to the applied voltage, it may become possible to temporarily form a liquid bridge of the conductive ink I having a column shape (hereinafter referred to as "liquid-column bridge") between the nozzle 21*a* and the conductive layer 12, thereby electrolyzing water included in the liquid-column bridge. As a result, the ink image I' may be formed on the intermediate transfer drum 10. In this case, on the surface of the conductive layer 12 serving as an anode, water included in the liquid-column bridge is oxidized to produce protons ($H^+$), and as a result, pigments P dispersed with anionic dispersant D aggregate together with the produced protons as shown in FIG. 2. Due to this feature, it may become possible to better control the occurrence of ink bleeding over to an adjacent dot and form a high-quality image.

Preferably, a gap between the conductive layer 12 of the intermediate transfer drum 10 and the nozzle plate 21 of the recording head 20 is in a range of 50 to 200 μm. When the gap is less than 50 μm, it may become difficult to maintain an appropriate gap between the conductive layer 12 of the rotating intermediate transfer, drum 10 and the nozzle plate 21. On the other hand, when the gap exceeds 200 μm, it may become difficult to form the liquid-column bridge. Further, a period from when the liquid-column bridge (B) is formed (FIG. 3B) to when the formed liquid-column bridge B is separated (FIG. 3C) can be controlled by changing, for example, the peak voltage and the pulse width of the voltage pulse applied to the piezoelectric element provided as the ink ejecting means.

The transfer roller 40 is rotatable and transfers the ink image I' to a recording paper (not shown) fed between the transfer roller 40 and the intermediate transfer drum 10. The transfer roller 40 may include a heater.

The cleaning blade 50 cleans the surface of the intermediate transfer drum 10 after the ink image I' is transferred to the recording paper. Instead of using the cleaning blade 50 alone, a cleaning roller may be additionally provided so as to be operated with the cleaning blade 50.

Further, a fixing roller may also be added to fix the ink image I' having been transferred to the recording paper.

Figure 3A:
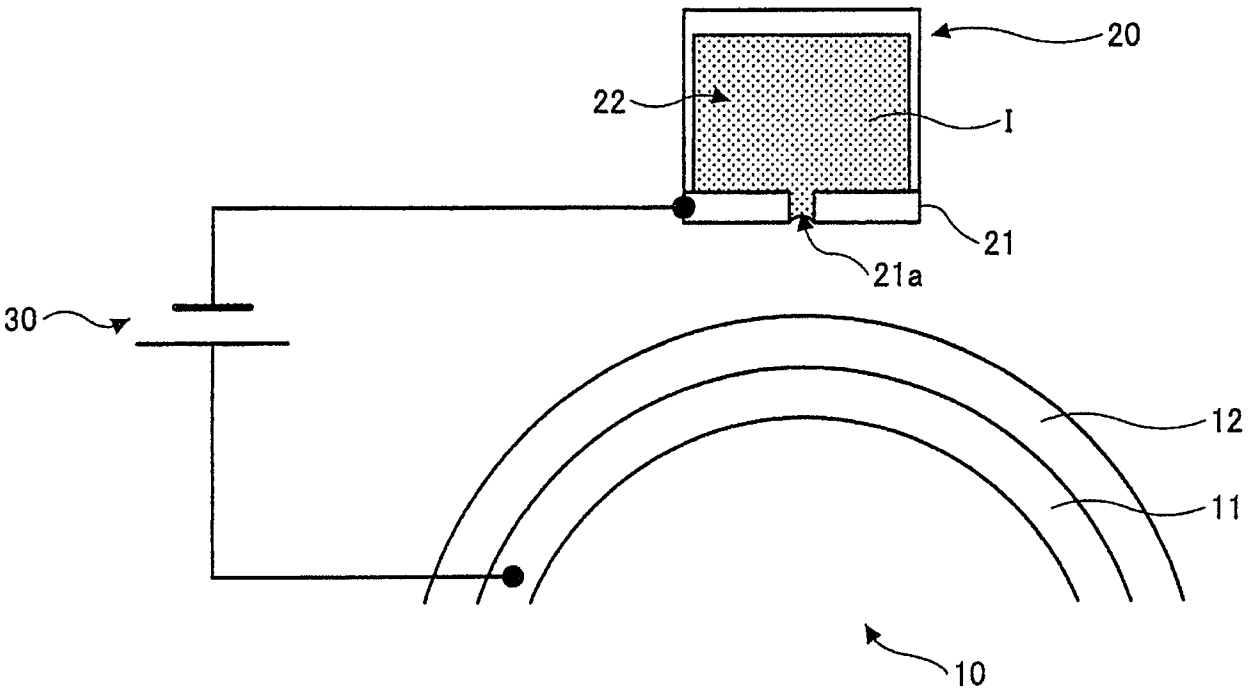
FIGS. 3A through 3C are drawings showing a mechanism of forming a positively-charged ink image.
Figure 3B:
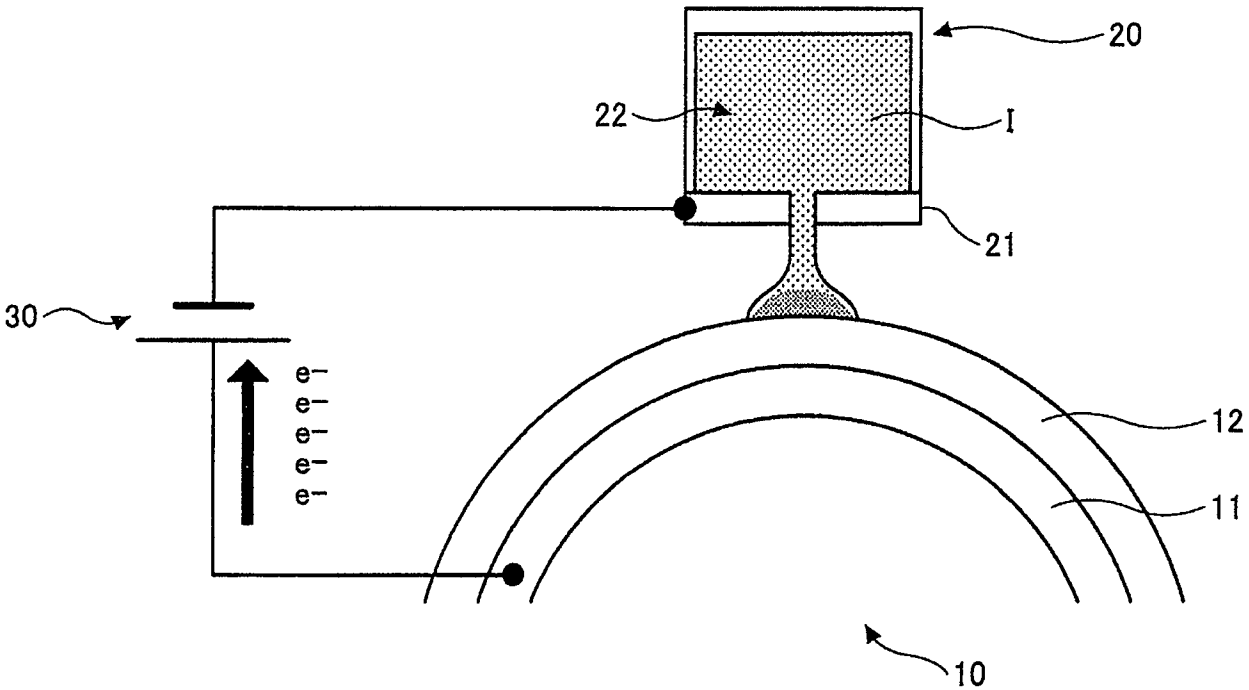
Figure 3C:
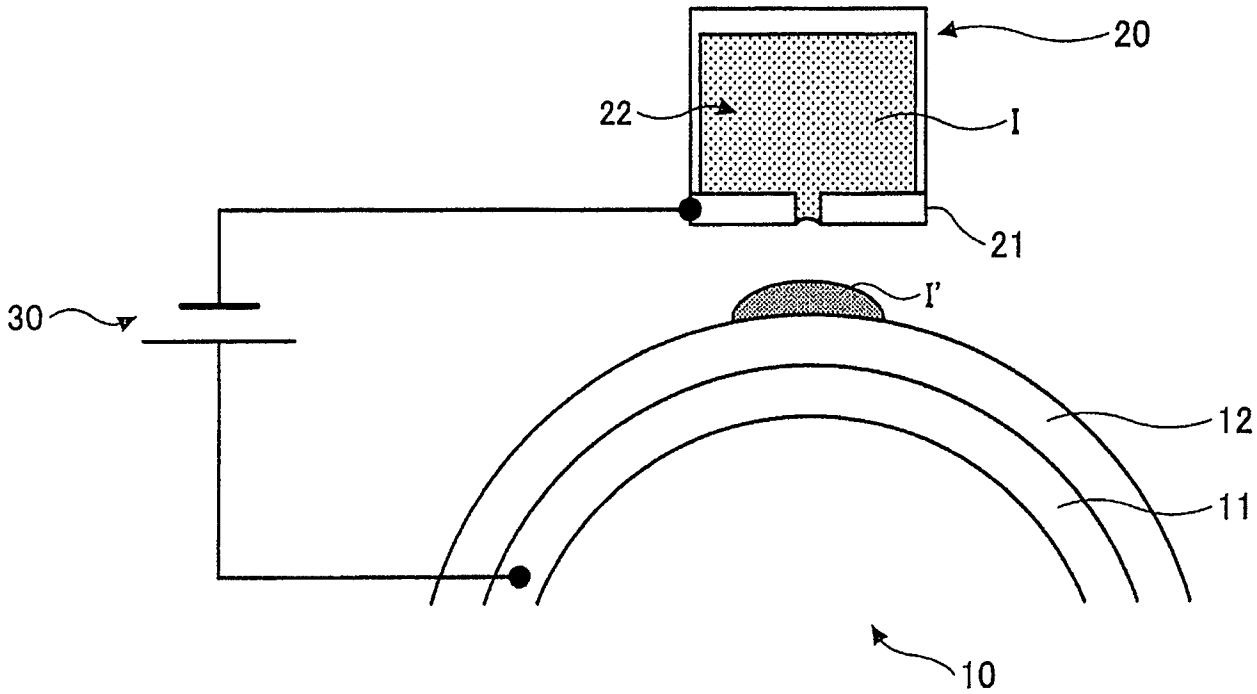

FIGS. 3A through 3C sequentially illustrates how the ink image I' is formed on the intermediate transfer drum 10. First, as shown in FIG. 3A, a meniscus of the conductive ink I filled in the ink chamber 22 is formed in the nozzle 21*a* and a predetermined voltage is applied by the power source 30. Next, as shown in FIG. 3B, a voltage pulse is applied to the piezoelectric element of the ink ejection means so that the conductive ink I is discharged from the nozzle 21*a* and the liquid-column bridge made of the conductive ink I is temporarily formed between the nozzle 21*a* and the conductive layer 12. In this case, the nozzle 21*a* and the conductive layer 12 serve as a cathode and an anode, respectively. Then, as shown in FIG. 3C, the liquid-column bridge of the conductive ink I is separated from the conductive ink I in the ink chamber 22, and as a result, the ink image I' is formed on the intermediate transfer drum 10.

Figure 4:
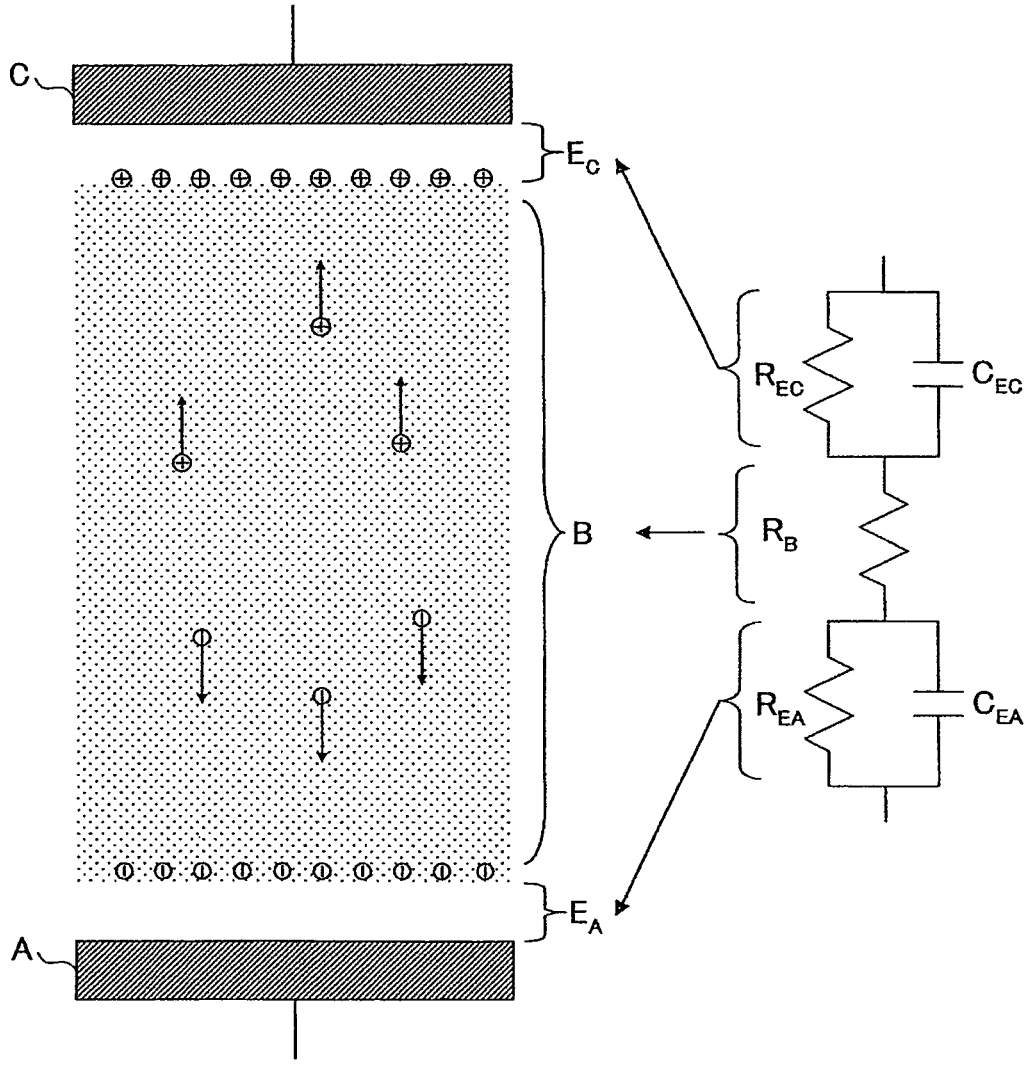
FIG. 4 is a drawing showing a liquid-column bridge formed between a cathode and an anode.

Next, with reference to FIG. 4, the liquid-column bridge B (i.e., a temporarily formed liquid bridge of the conductive ink I having a column shape) is described. As shown in FIG. 4, in the liquid-column bridge, cations and anions are moved closer to the cathode C and anode A, respectively. As a result, electric double layers $E_C$ and $E_A$ are formed closer to the cathode C and the anode A, respectively. The charging speed of the electric double layers $E_C$ and $E_A$ is typically determined based on the conductivity of the liquid-column bridge B and the concentration of ions in the conductive ink I. In this case, when the voltage of the electric double layer $E_A$ reaches several volts, water in the liquid-column bridge B is electrolyzed and a faradaic current flows. As a result, on the surface of the anode A, water is oxidized to produce protons ($H^+$) and due to the produced protons, the pigments P dispersed with anionic dispersant D aggregate together with the produced protons as shown in FIG. 2. On the other hand, a capacity $C_{EC}$ of the electric double layer $E_C$ is sufficiently greater than a capacity $C_{EA}$ of the electric double layer $E_A$; therefore, on the surface of the cathode C, water is slightly reduced. This is because the area of the nozzle 21*a* contacting the conductive ink I as the cathode C is sufficiently greater than the area of the conductive layer 12 contacting the liquid-column bridge B as the anode A. Further, an aggregation level of the pigments may be controlled by changing an amount of produced protons, i.e., by changing the period from when the liquid-column bridge (B) is formed (FIG. 3B) to when the formed liquid-column bridge B is separated (FIG. 3C) and the voltage applied by the power source 30. Further, when water is electrolyzed to produce protons, oxygen is also produced. However, since the amount of produced oxygen is limited and the produced oxygen is thought to be dissolved in water, the produced oxygen does not disturb the image forming.

Typically, the period from when the liquid-column bridge B is formed (FIG. 3B) to when the formed liquid-column bridge B is separated (FIG. 3C) is in a range of several microseconds to several tens of microseconds. The conductivity of the conductive ink is typically in a range of several tens of milliseconds per meter to several hundreds of milliseconds per meter. Because of the features, in order to form the ink image I' on the intermediate transfer drum 10, a voltage applied by the power source 30 in a range of several volts to a dozen volts may not be good enough, and preferably, the voltage in a range of several tens of volts to several hundreds of volts may be required to be applied.

Figure 5:
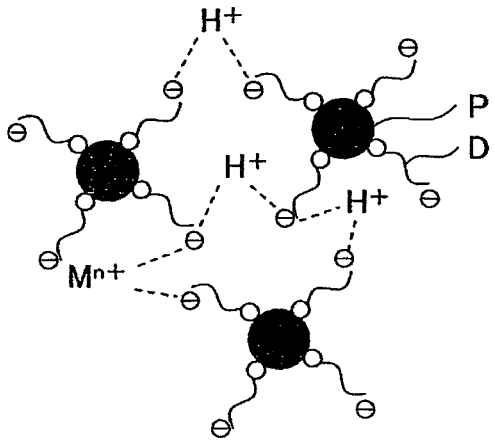
FIG. 5 is a drawing showing where pigments that were dispersed in anionic dispersant are aggregated together with protons and metal cations.

Further, instead of using the intermediate transfer drum 10, when the conductive substrate 11 without the conductive layer 12 is used as the intermediate transfer drum, on the surface of the conductive substrate 11 serving as an anode, not only water but also metal of the conductive substrate 11 is oxidized. As a result, besides the protons, metal cations having an excellent capability of aggregating the pigments are produced. Therefore, as shown in FIG. 5, the pigments P dispersed with anionic dispersant D can be aggregated together with the generated metal cations ($M^{n+}$) in addition to protons.

Figure 13:
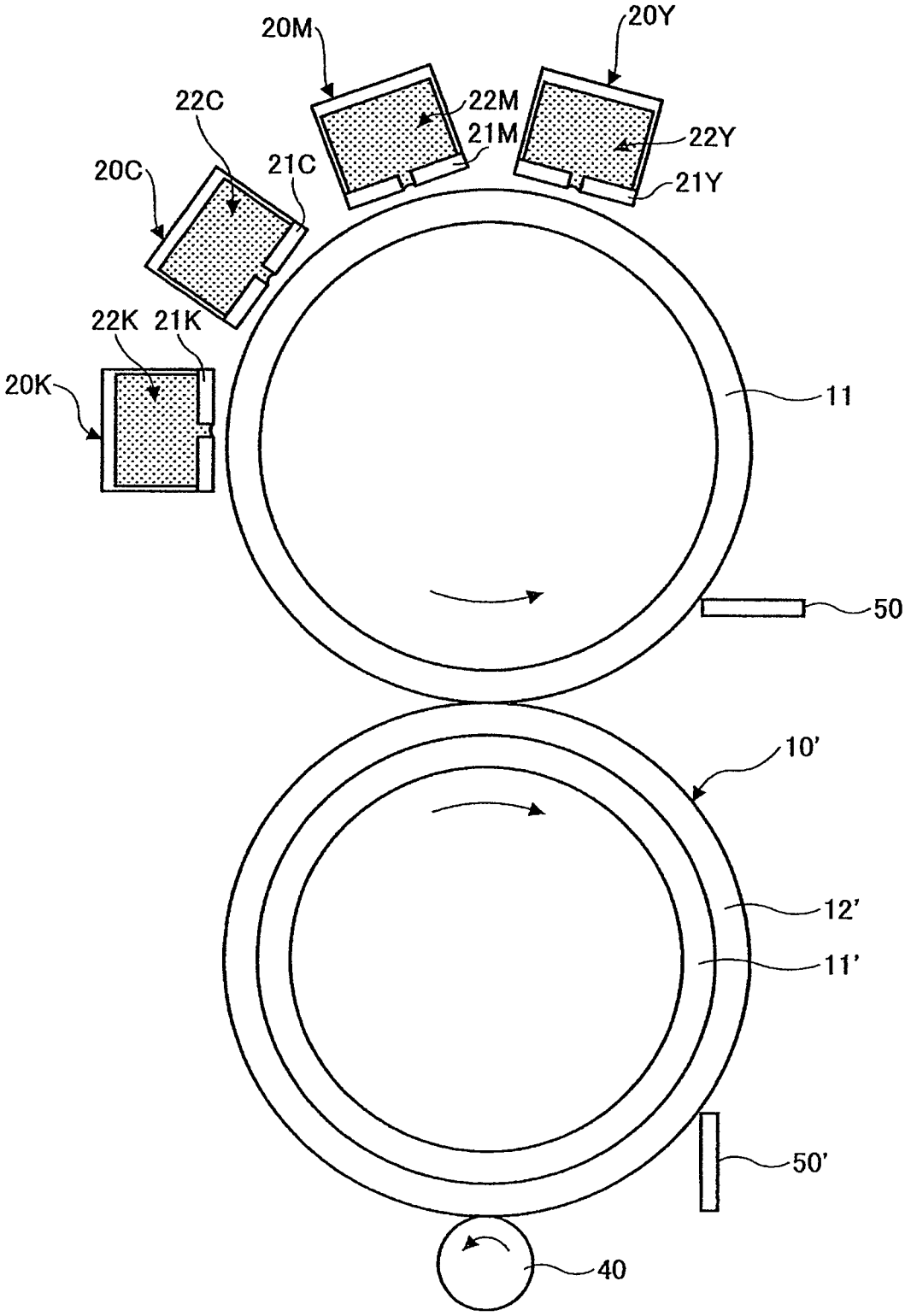
FIG. 13 is a schematic drawing showing an image forming apparatus according to a fifth embodiment of the present invention.

In this case, preferably, another intermediate transfer drum having a substrate and a rubber layer formed on the substrate may be provided between the conductive substrate 11 and the transfer roller 40 (as shown in FIG. 13). By doing this, after transferring the ink image I' formed on the conductive substrate 11 to the intermediate transfer drum, the ink image I' formed on the intermediate transfer drum may be transferred to the recording paper; and therefore, transfer performance may be improved. There are no particular restrictions on the material of the conductive substrate 11 and specific examples are metals such as aluminum, aluminum alloy, copper, and stainless. Further, there are no particular restrictions on the material of the rubber layer and specific examples are silicone rubber, urethane rubber, fluoro rubber, and nitrile-butadiene rubber.

In the above description, the pigments dispersed with anionic dispersant are aggregated together with protons produced on the surface of the conductive layer 12 serving as an anode. However, alternatively, the pigments dispersed with cationic dispersant are aggregated together with hydroxide ions produced on the surface of the conductive, layer 12 serving as a cathode.

Embodiments

Preparation of Black Conductive Ink

First, 35.0 wt % of sulfonic group binding-type carbon black pigment dispersion, CAB-O-JET-200 (Cabot Specialty Chemicals, Inc.) (solid content: 20 wt %), 10.0 wt % of 2-pyrrolidone, 14.0 wt % of glycerin, 0.9 wt % of propylene glycol monobutyl ether, 0.1 wt % of dehydroacetic soda, and water as a balance were mixed to obtain a mixture. Next, the pH of the mixture was adjusted to 9.1 by adding an aqueous solution of 5 wt % lithium hydroxide and then the mixture was subjected to pressure filtration using a membrane filter having an average pore size of 0.8 thereby obtaining black conductive ink.

Preparation of Yellow Conductive Ink

First, 40.0 wt % of sulfonic group binding-type yellow pigment dispersion, CAB-O-JET-270Y (Cabot Specialty Chemicals, Inc.) (solid content: 10 wt %), 15.0 wt % of triethylene glycol, 25.0 wt % of glycerin, 6.0 wt % of propylene glycol monobutyl ether, 0.1 wt % of dehydroacetic soda, and water as a balance were mixed to obtain a mixture. Next, the pH of the mixture was adjusted to 9.1 by adding an aqueous solution of 5 wt % lithium hydroxide and then the mixture was subjected to pressure filtration using a membrane filter having an average pore size of 0.8 μm, thereby obtaining yellow conductive ink.

Preparation of Magenta Conductive Ink

First, 40.0 wt % of sulfonic group binding-type magenta pigment dispersion, CAB-O-JET-260M (Cabot Specialty Chemicals, Inc.) (solid content: 10 wt %), 20.0 wt % of diethylene glycol, 3.0 wt % of propylene glycol monobutyl ether, 0.1 wt % of dehydroacetic soda, and water as a balance were mixed to obtain a mixture. Next, the pH of the mixture was adjusted to 9.1 by adding an aqueous solution of 5 wt % lithium hydroxide and then the mixture was subjected to pressure filtration using a membrane filter having an average pore size of 0.8 μm, thereby obtaining magenta conductive ink.

Preparation of Cyan Conductive Ink

First, 40.0 wt % of sulfonic group binding-type cyan pigment dispersion, CAB-O-JET-250C (Cabot Specialty Chemicals, Inc.) (solid content: 10 wt %), 4.0 wt % of ethylene glycol, 14.0 wt % of triethylene glycol, 6.0 wt % of propylene glycol monobutyl ether, 0.1 wt % of dehydroacetic soda, and water as a balance were mixed to obtain a mixture. Next, the pH of the mixture was adjusted to 9.1 by adding an aqueous solution of 5 wt % lithium hydroxide and then the mixture was subjected to pressure filtration using a membrane filter having an average pore size of 0.8 μm, thereby obtaining cyan conductive ink.

First Embodiment

Figure 6:
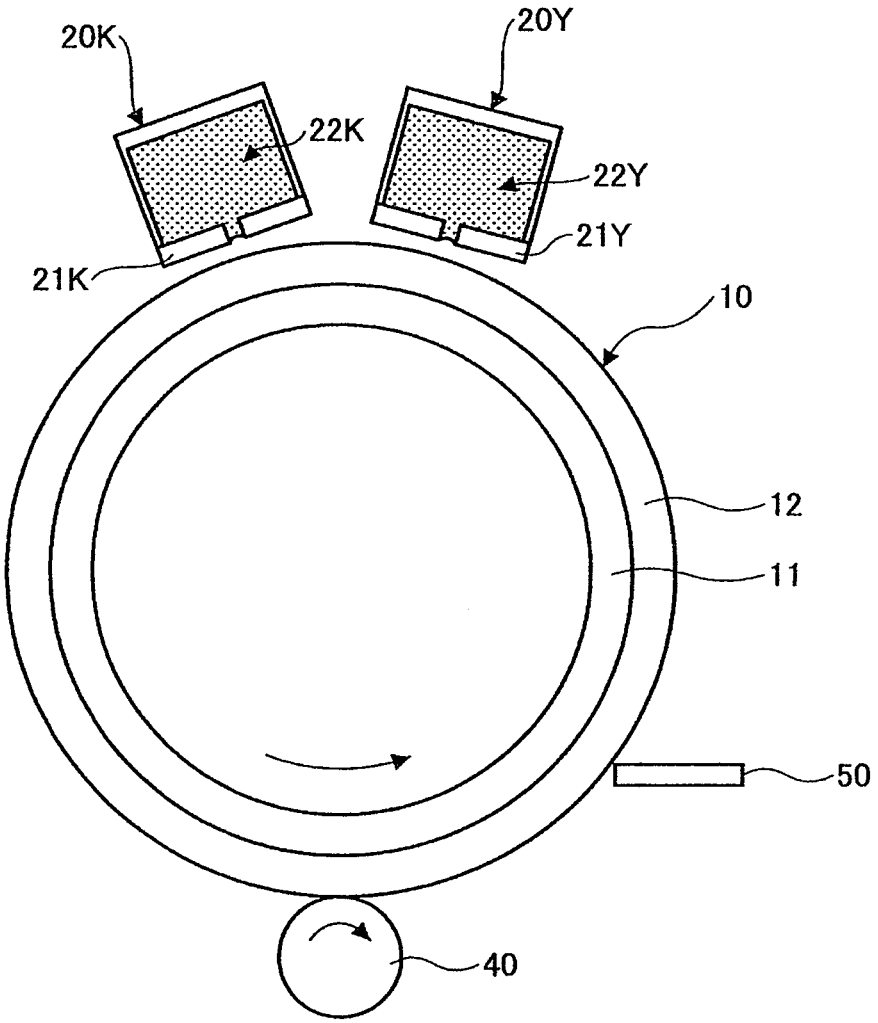
FIG. 6 is a schematic drawing showing an image forming apparatus according to a first embodiment of the present invention.

According to a first embodiment of the present invention, an image forming apparatus as shown in FIG. 6 is provided. The image forming apparatus in FIG. 6 is the same as the image forming apparatus in FIG. 1 except that the image forming apparatus in FIG. 6 includes a yellow recording head 20Y and a black recording head 20K in this order for printing their color images in this order. The same reference numerals are used in FIG. 6 to describe the same or equivalent components of FIG. 1 and the descriptions thereof may be omitted. The intermediate transfer drum 10 includes an aluminum round tube (i.e., conductive substrate 11) and a silicone rubber layer (i.e., conductive layer 12) formed on the outer circumference of the aluminum round tube, the silicone rubber layer having volume resistivity of 5 Ω·cm and thickness of 0.2 mm and including dispersed carbon. The intermediate transfer drum 10 is driven by a drive means (not shown) so as to be rotated at a line speed of the outer circumference of 50 mm/sec in the counterclockwise direction. The recording heads 20Y and 20K include metal nozzle plates 21Y and 21K, and ink chambers 22Y and 22K, respectively, configuring an inkjet printer GX5000 (Ricoh Company, Ltd.). Yellow ink and black ink are filled in the ink chambers 22Y and 22K, respectively. Further, the power source (not shown) is connected between each of the nozzle plates 21Y and 21K and the conductive substrate 11. The gap between the conductive layer 12 of the intermediate transfer drum 10 and each of the nozzle plates 21Y and 21K of the recording heads 20 Y and 20K, respectively, is 100 μm. The transfer roller 40 includes a core shaft made of a metal and a rubber layer formed on the core shaft and having a thickness of 5 mm. The cleaning blade 50 is made of fluoro rubber.

With the above described image forming apparatus, an evaluation is performed based on the following procedure. In the evaluation procedure, in order to collect the conductive ink, the transfer roller 40 is separated from the intermediate transfer drum 10.

(1) Set 0V as the voltage of power supply
(2) Use the yellow recording head 20Y to form yellow halftone dot pattern of isolated dots having a dot diameter of 50 μm within a continuous band area having a width of 1 inch along the direction perpendicular to the moving direction of the surface of the intermediate transfer drum 10 (i.e., along the main scanning direction)
(3) Use the black recording head 20K to form black halftone dot pattern of isolated dots having a dot diameter of 50 μm so that the position of the formed black halftone dot pattern is shifted from that of the yellow halftone dot pattern by 35 μm.
(4) Take a picture of the intermediate transfer drum 10 and calculate a roundness rate defined below to evaluate a bleeding level of the dot of the black conductive ink ejected from the recording head 20K.
(5) Measure the pH of conductive ink collected by the cleaning blade 50.
(6) Increase the voltage of the power source by 10V.
(7) Repeat the operations (1) to (6)

Figure 7A:
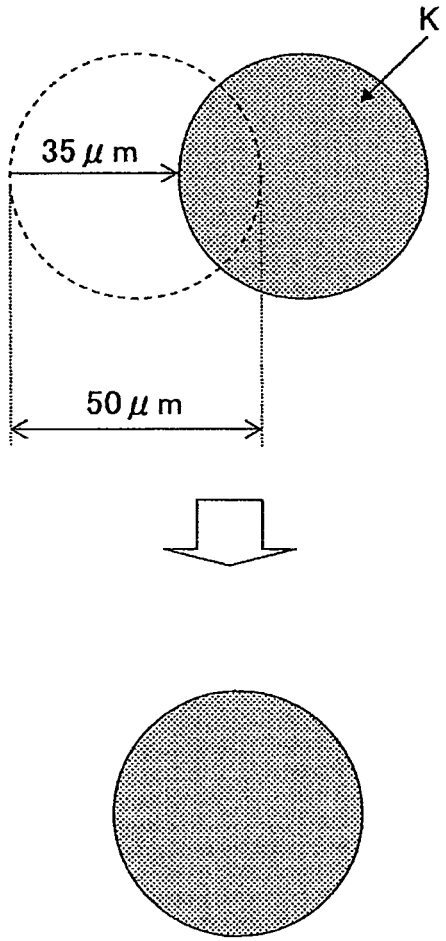
FIGS. 7A through 7C are drawings illustrating a roundness rate.
Figure 7B:
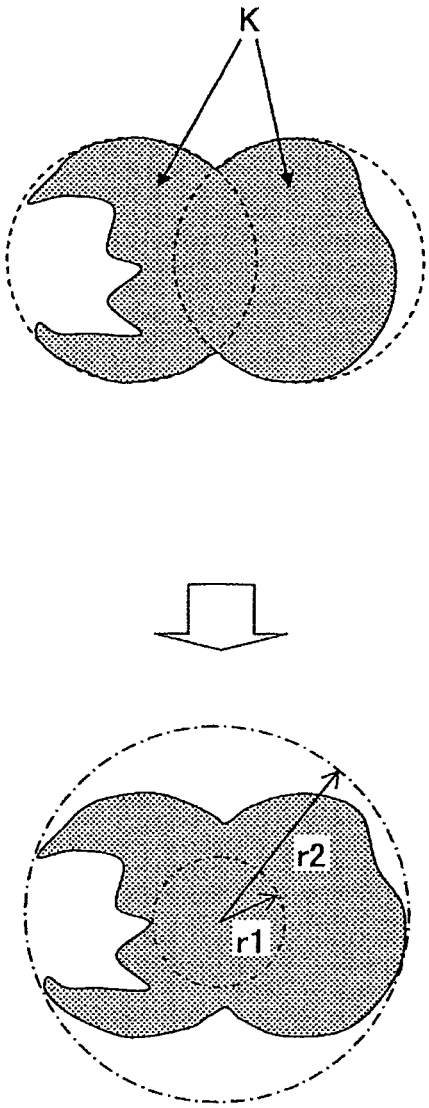
Figure 7C:
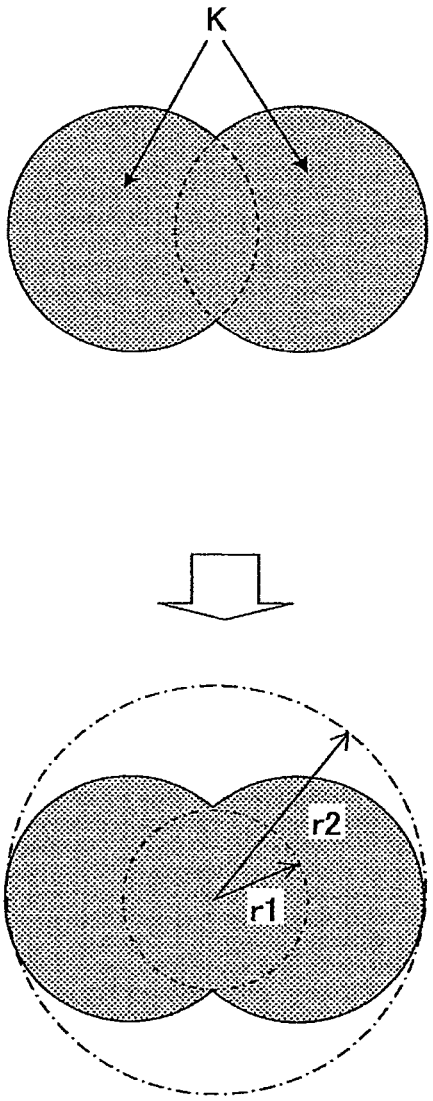

Herein, the roundness rate is defined as a maximum value of a ratio (≤1) of the radiuses (i.e., r1/r2) of two concentric circles defining the area where black pigment (ink) is applied (bled) on the intermediate transfer drum. More specifically, in a case of FIG. 7A, there is no boundary bleeding of black ink between the black ink dot and the adjacent yellow ink dot. Namely, an area (K) including black ink becomes a circle, therefore, the roundness rate (r1/r2) becomes 1. In a case of FIG. 7B, some degree of boundary bleeding is observed. The roundness rate in this case is calculated based on r1/r2. In a case of FIG. 7C, full boundary bleeding is observed. Namely, the area (K) contains all of the black ink dot and the adjacent yellow ink dot. The roundness rate in this case is calculated based on r1/r2.

Figure 8:
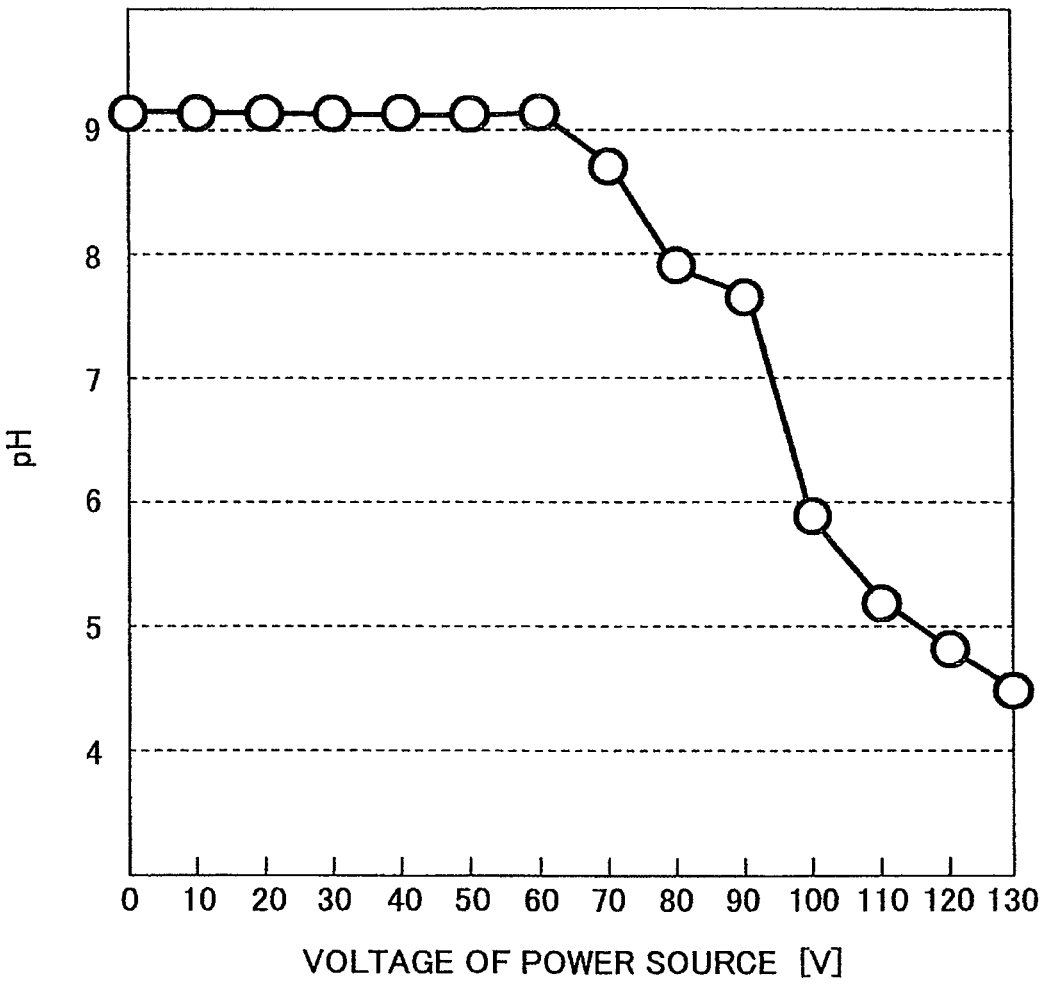
FIG. 8 is a graph showing a relationship between pH values and voltages of a power source according to the first embodiment of the present invention.
Figure 9:
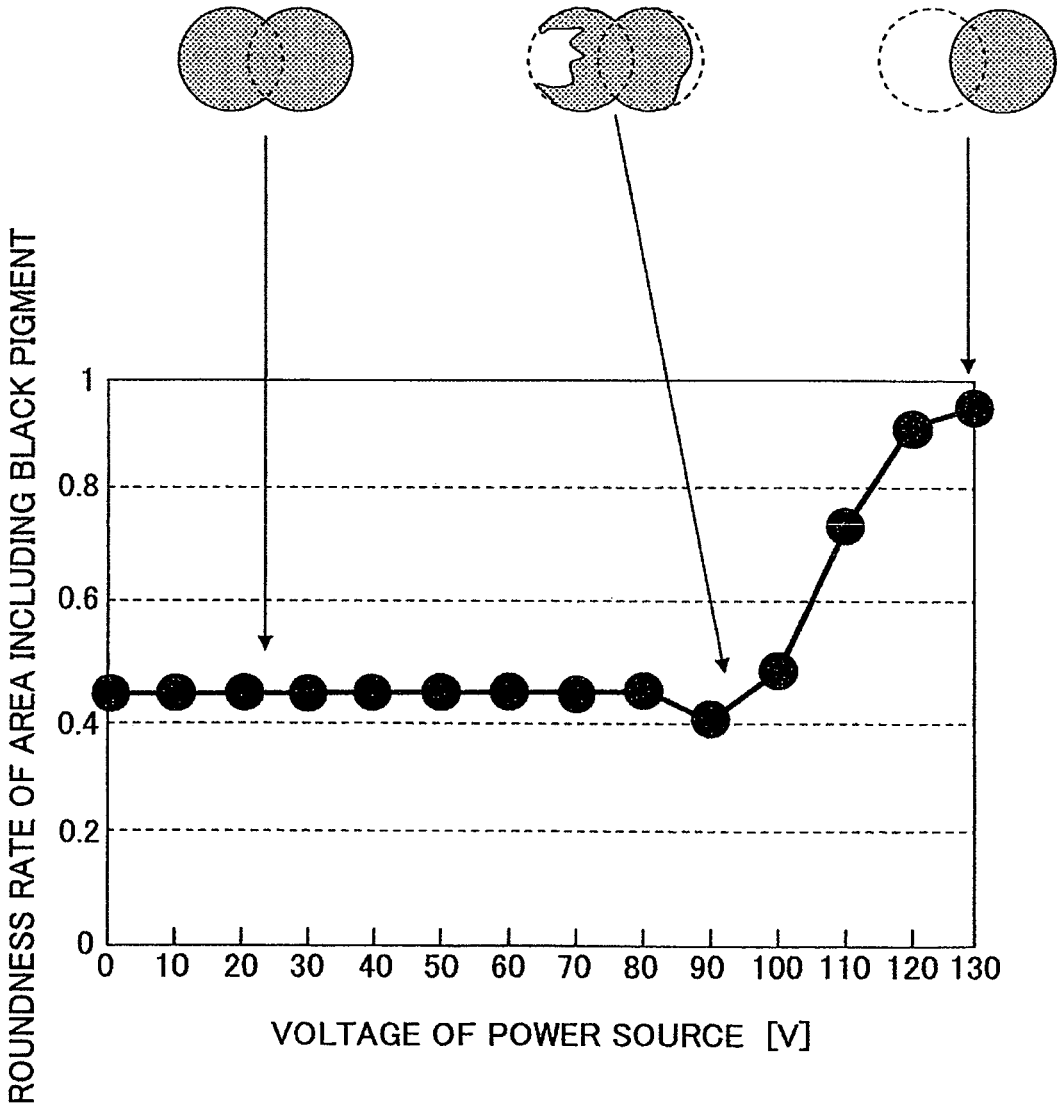
FIG. 9 is a graph showing a relationship between the roundness rate with respect to an area where black pigment is included and the voltage of the power source according to the first embodiment of the present invention.

As a result of the evaluation, FIG. 8 shows a relationship between pH values and voltages of the power source and FIG. 9 shows a relationship between the roundness rate with respect to the area K where black pigment is included and the voltage of the power source. As shown in FIG. 8, the pH value decreases when the voltage of the power supply exceeds 60 V. Namely, it may be thought that, when the voltage of the power supply exceeds 60 V, an amount of protons included in the collected conductive ink increases and that water is oxidized on the surface of the conductive layer 12. Further, from FIG. 9, when the pH value is less than 6.0, the bleeding of black ink to the dot of other color (yellow) is better controlled. Therefore, it may be thought when water is fully oxidized, the effect of aggregating the conductive ink (pigments) are developed.

In this first embodiment of the present invention, it may be thought that water is oxidized when the voltage of the power source exceeds 60V. However, the voltage necessary to oxidize water may vary depending on property of the conductive ink, dynamics forming the liquid-column bridge and the like.

Second Embodiment

According to a second embodiment of the present invention, the evaluation is performed in the same conditions as that in the first embodiment of the present invention except that, instead of using the intermediate transfer drum 10, a stainless round tube (i.e., conductive substrate 11) is used as the intermediate transfer drum.

Figure 10:
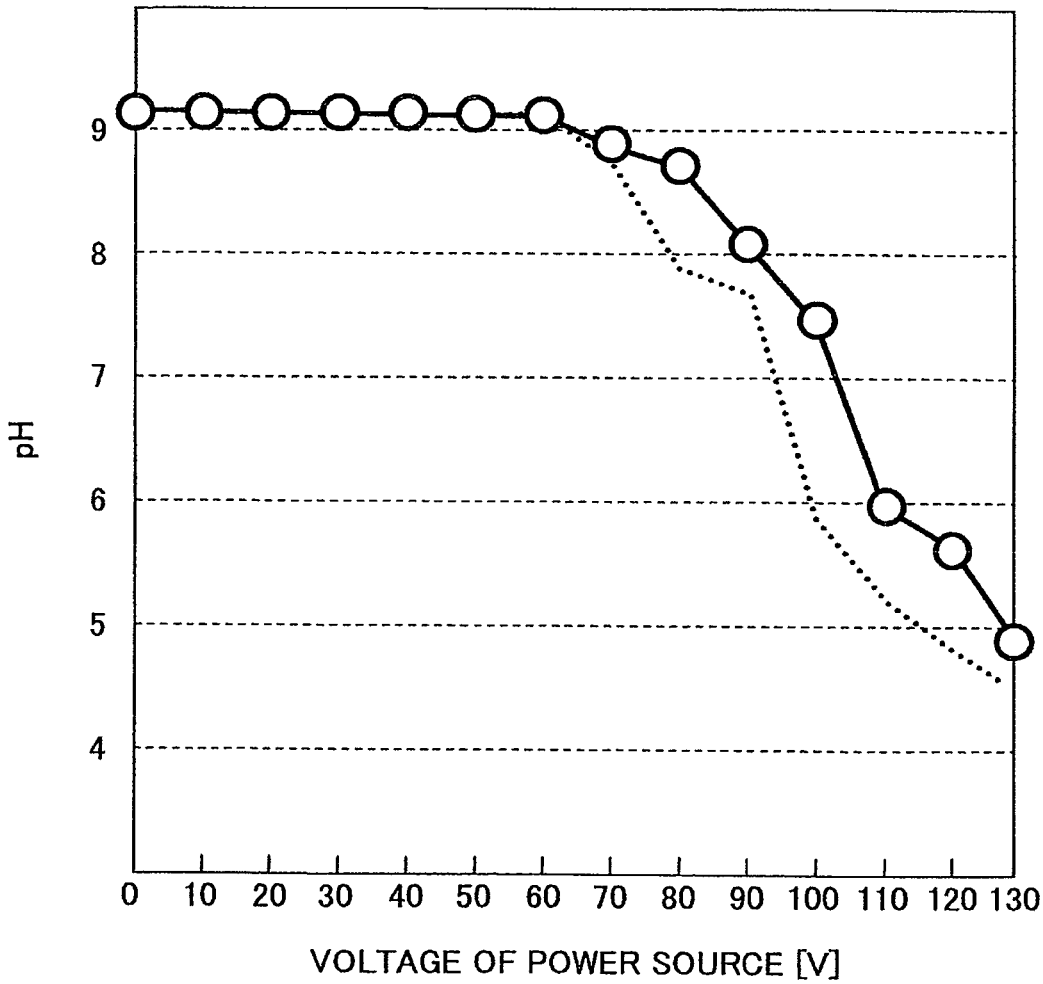
FIG. 10 is a graph showing a relationship between the pH values and the voltages of the power source according to a second embodiment of the present invention.
Figure 11:
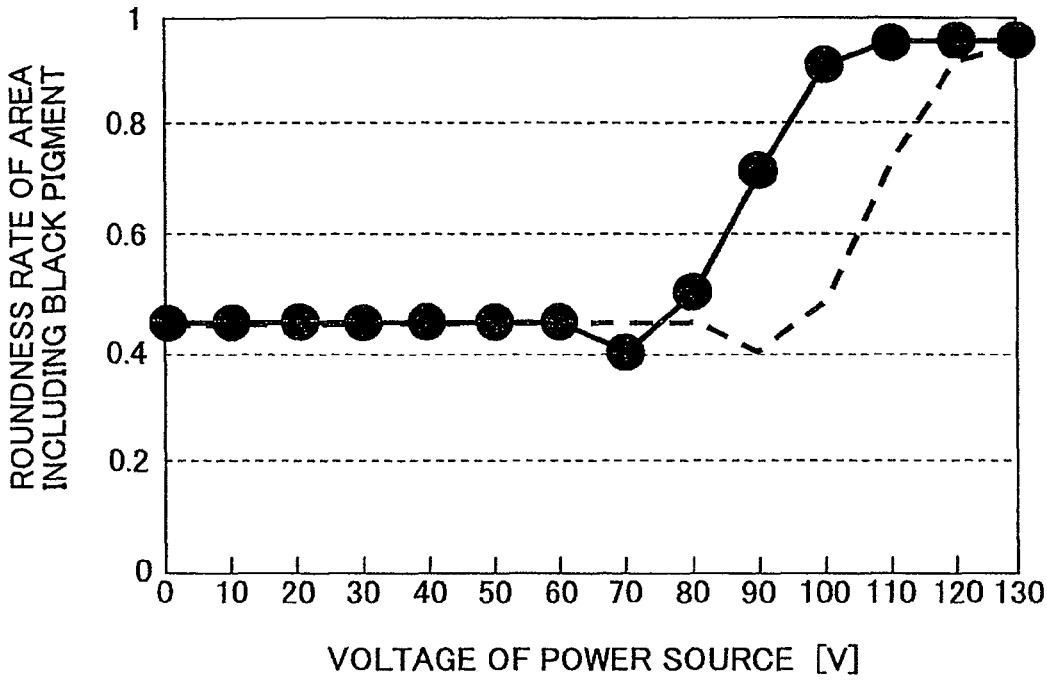
FIG. 11 is a graph showing a relationship between the roundness rate with respect to the area where black pigment is included and the voltage of the power source according to the second embodiment of the present invention.

As a result of the evaluation, FIG. 10 shows a relationship between pH values and voltages of the power source and FIG. 11 shows a relationship between the roundness rate with respect to the area K where black pigment is included and the voltage of the power source. In FIGS. 10 and 11, data of FIGS. 8 and 9, respectively, are also plotted using dotted lines for comparison. From FIG. 10, the pH values start decreasing at a slightly higher voltage when compared with data of FIG. 8 (i.e., data of the first embodiment of the present invention). On the other hand, from FIG. 11, the effect of controlling the bleeding of black ink to the dot of other color is obtained from a slightly lower voltage when compared with data of FIG. 9 (i.e., data of the first embodiment of the present invention). Based on the results, it may be thought that water is oxidized and metal of the conductive substrate 11 is also oxidized to produce metal cations.

Further, the inductive ink collected by the cleaning blade 50 is analyzed using Energy Dispersive X-ray Spectroscopy. As a result, a peak of Fe (not included in the same ink right after being prepared) is detected.

Third Embodiment

Figure 12:
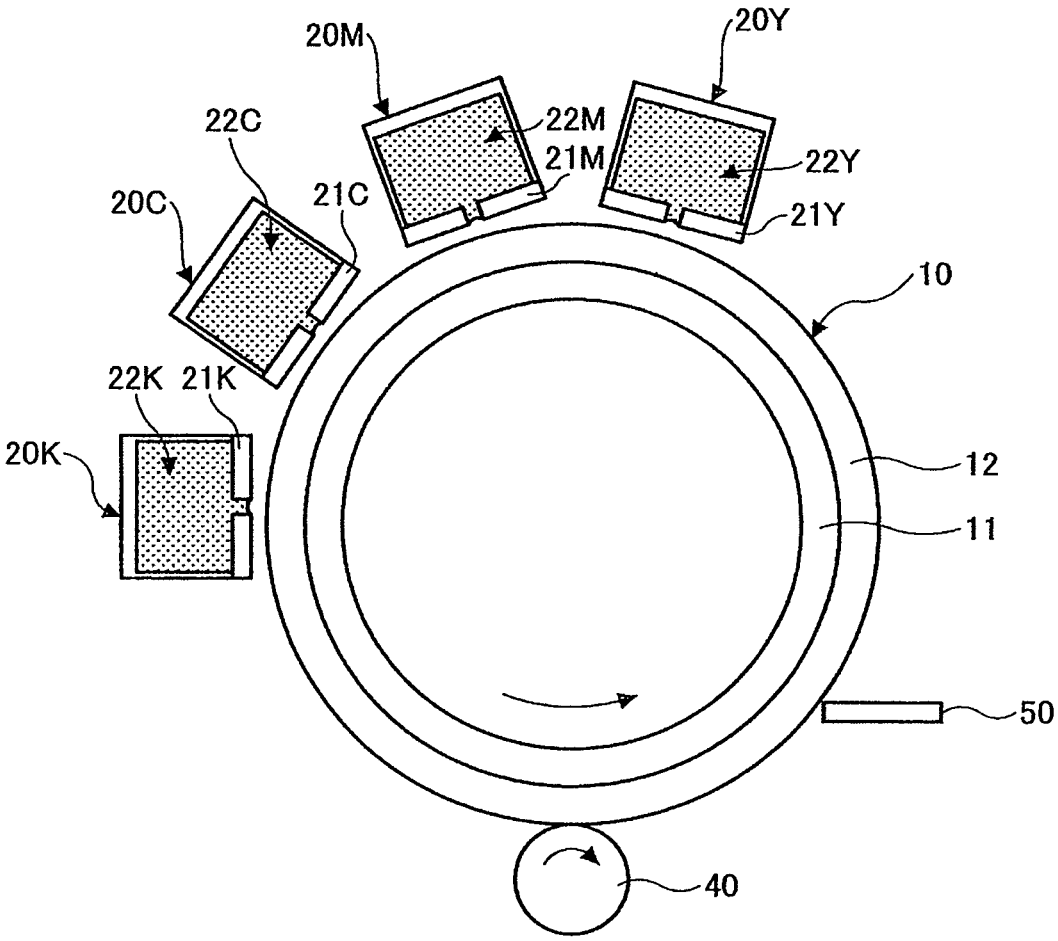
FIG. 12 is a schematic drawing showing an image forming apparatus according to a third embodiment of the present invention.

According to a third embodiment of the present invention, an image forming apparatus as shown in FIG. 12 is provided. The image forming apparatus in FIG. 12 is the same as that in FIG. 1 except that the image forming apparatus in FIG. 6 includes the yellow recording head 20Y, a magenta recording head 20M, a cyan recording head 20C, and the black recording head 20K in this order for printing their color images in this order. The same reference numerals are used in FIG. 12 to describe the same or equivalent components of FIG. 1 and the descriptions thereof may be omitted. The intermediate transfer drum 10 includes the aluminum round tube (i.e., conductive substrate 11) and the silicone rubber layer (i.e., conductive layer 12) formed on the outer circumference of the aluminum round tube, the silicone rubber layer having volume resistivity of 5 Ω·cm and thickness of 0.2 mm and including dispersed carbon. The intermediate transfer drum 10 is driven by the drive means (not shown) so as to be rotated at a line speed of the outer circumference of 50 mm/sec in the counterclockwise direction. The recording heads 20Y, 20M, 20C, and 20K include metal nozzle plates 21Y, 21M, 21C, and 21K, and ink chambers 22Y, 22M, 22C, and 22K, respectively, configuring an inkjet printer GX5000 (Ricoh Company, Ltd.). Yellow ink, magenta ink, cyan ink, and black ink are filled in the ink chambers 22Y, 22M, 22C, and 22K, respectively. Further, the power source (not shown) is connected between each of the nozzle plates 21Y, 21M, 21C, and 21K and the conductive substrate 11. The gap between the conductive layer 12 of the intermediate transfer drum 10 and the nozzle plates 21Y, 21M, 21C, and 21K of the recording heads 20Y, 20M, 20C, and 20K, respectively, is 100 μm. The transfer roller 40 includes a core shaft made of a metal and a rubber layer formed on the core shaft and having a thickness of 5 mm. The cleaning blade 50 is made of fluoro rubber.

In the above image forming apparatus as shown in FIG. 12, by setting the voltage of the power source to 120 V, and applying the voltage pulse so that the time period from when the liquid-column bridge (B) is formed (FIG. 3B) to when the formed liquid-column bridge B is separated (FIG. 3C) is several tens of microseconds, an ink image is formed on the intermediate transfer drum 10. Next, by using the transfer roller 40, the ink image formed on, the intermediate transfer drum 10 is transferred to a plain paper (recording paper). As a result, good dot reproducibility and image quality are obtained.

Comparative Example 1

In the same conditions as those in the third embodiment of the present invention except that the voltage of the power source is set to 0 V, the ink image is formed. As a result, there are many ink bleeding detected and inductive ink exudes to the opposite surface of the plain paper.

Fourth Embodiment

According to a fourth embodiment of the present invention, there is provided an image forming apparatus same as that in the third embodiment of the present invention except that instead of using the intermediate transfer drum 10, a stainless round tube (i.e., conductive substrate 11) is used as the intermediate transfer drum.

In the above image forming apparatus, by setting the voltage of the power source to 100 V, and applying the voltage pulse to the piezoelectric element in the recording head 20 so that the time period from when the liquid-column bridge (B) is formed (FIG. 3B) to when the formed liquid-column bridge B is separated (FIG. 3C) is several tens of microseconds, an ink image is formed on the conductive substrate 11. Next, by using the transfer roller 40, the ink image formed on the conductive substrate 11 is transferred to a plain paper (recording paper). In this case, since there is no conductive layer 12 formed on the intermediate transfer drum used in this fourth embodiment of the present invention, the pressing force of the transfer roller 40 to the conductive substrate 11 is larger than that in the third embodiment of the present invention. As a result, good dot reproducibility and image quality are obtained.

Fifth Embodiment

According to a fifth embodiment of the present invention, there is provided an image forming apparatus same as that in the fourth embodiment of the present invention except that an intermediate transfer drum 10' and a cleaning blade 50' are additionally provided between the stainless round tube (i.e., conductive substrate 11) and the transfer roller 40 as shown in FIG. 13. The intermediate transfer drum 10' includes an aluminum round tube (i.e., conductive substrate 11) and the silicone rubber layer (i.e., rubber layer 12') formed on the outer circumference of the aluminum round tube, the silicone rubber layer having thickness of 0.2 mm. The cleaning blade 50' is made of fluoro rubber.

In the above image forming apparatus, by setting the voltage of the power source to 100 V, and applying the voltage pulse to the piezoelectric element in the recording head 20 so that the time period from when the liquid-column bridge (B) is formed (FIG. 3B) to when the formed liquid-column bridge B is separated (FIG. 3C) is several tens of microseconds, an ink image is formed on the conductive substrate 11. Next, the ink image formed on the conductive substrate 11 is transferred to the intermediate transfer drum 10'. In this case, by using a drive means (not shown), the conductive substrate 11 is rotated so that a line speed of the outer circumference of the conductive substrate 11 is faster than that of the intermediate transfer drum 10' by several percent. Further, since the rubber layer (isolation layer) 12° is formed in the intermediate transfer drum 10', the pressing force of the transfer roller 40 to the intermediate transfer drum 10' is smaller than that in the fourth embodiment of the present invention. As a result, good dot reproducibility and image quality are obtained.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

The present application is based on and claims the benefit of priority of Japanese Patent Application No. 2009-037033, filed on Feb. 19, 2009, the entire contents of which are hereby incorporated herein by reference.

The invention claimed is:

1. An image forming apparatus comprising:

a recording head having, an ink chamber configured to store inductive ink therein, the inductive ink including a pigment dispersed in water, and a nozzle capable of ejecting the inductive ink including the water from the ink chamber;

a first intermediate transfer body having a conductive substrate electrically connected to a conductive surface, the conductive surface configured to have an ink image formed thereon;

a voltage application unit configured to, temporarily form, during the ejection of the inductive ink from the nozzle, a liquid-column bridge, made of the inductive ink including the pigment and the water, between the conductive surface and the nozzle of the recording head by applying a voltage between the inductive ink in the recording head and the conductive substrate, and electrolyze the water from the inductive ink included in the liquid-column bridge to decompose the water in the inductive ink into oxygen and protons; and a transfer unit configured to transfer the ink image formed on the first intermediate transfer body to a recording medium.

2. The image forming apparatus according to claim 1, wherein the conductive surface includes rubber in which a conductive agent is dispersed or metal.

3. The image forming apparatus according to claim 1, further comprising:

a second intermediate transfer body having a surface on which a rubber layer is formed, wherein the transfer unit primarily transfers the ink image formed on the first intermediate transfer body to the second intermediate transfer body and then secondarily transfers the ink image primarily transferred on the second intermediate transfer body to a recording medium.

4. An image forming method comprising:

forming an ink image on an intermediate transfer body by, discharging inductive ink including a pigment dispersed in water from a nozzle of a recording head toward a conductive surface of the intermediate transfer body, the conductive surface being electrically connected to a conductive substrate;

forming, temporarily, a liquid-column bridge during the ejection of the inductive ink from the nozzle, the liquid-column bridge made of the inductive ink including the pigment and the water, the liquid-column bridge formed between the conductive surface and the nozzle of the recording head by applying a voltage between the inductive ink in the recording head and the conductive substrate, and electrolyzing the water from the inductive ink included in the liquid-column bridge to decompose the water in the inductive ink into oxygen and protons; and transferring the ink image formed on the intermediate transfer body to a recording medium.

5. The image forming method according to claim 4, wherein in the inductive ink, the pigment is dispersed with an anionic dispersant.

6. The image forming method according to claim 5, wherein near the conductive surface, the water included in the liquid-column bridge is oxidized so as to produce the protons to aggregate the pigment.

7. The image forming method according to claim 6, wherein the conductive surface is made of metal, and near the conductive surface, the metal is oxidized to produce metal ions so as to aggregate the pigment.

8. The image forming method according to claim 4, wherein the transfer step includes a step of primarily transferring the ink image formed on the intermediate transfer body to another intermediate transfer body having a surface on which a rubber layer is formed and a step of secondarily transferring the ink image primarily transferred on the another intermediate transfer body to a recording medium.

9. The image forming apparatus according to claim 2, further comprising:

a second intermediate transfer body having a surface on which a rubber layer is formed, wherein the transfer unit primarily transfers the ink image formed on the first intermediate transfer body to the second intermediate transfer body and then secondarily transfers the ink image primarily transferred on the second intermediate transfer body to a recording medium.

10. The image forming method according to claim 5, wherein the transfer step includes a step of primarily transferring the ink image formed on the intermediate transfer body to another intermediate transfer body having a surface on which a rubber layer is formed and a step of secondarily transferring the ink image primarily transferred on the another intermediate transfer body to a recording medium.

11. The image forming method according to claim 6, wherein the transfer step includes a step of primarily transferring the ink image formed on the intermediate transfer body to another intermediate transfer body having a surface on which a rubber layer is formed and a step of secondarily transferring the ink image primarily transferred on the another intermediate transfer body to a recording medium.

12. The image forming method according to claim 7, wherein the transfer step includes a step of primarily transferring the ink image formed on the intermediate transfer body to another intermediate transfer body having a surface on which a rubber layer is formed and a step of secondarily transferring the ink image primarily transferred on the another intermediate transfer body to a recording medium.

* * * * *